United States Patent [19]

Kitayama et al.

[11] Patent Number: 4,537,792

[45] Date of Patent: Aug. 27, 1985

[54] METHOD OF APPLYING AN ANNEALING SEPARATOR TO GRAIN ORIENTED MAGNETIC STEEL SHEETS

[75] Inventors: Minoru Kitayama; Motoharu Nakamura; Kikuji Hirose; Masashi Tanida, all of Himejishi, Japan

[73] Assignee: Nippon Steel Corporation, Tokyo, Japan

[21] Appl. No.: 537,665

[22] Filed: Sep. 30, 1983

[30] Foreign Application Priority Data

Oct. 7, 1982 [JP] Japan ..... 57-175285

[51] Int. Cl.[3] ..... B05D 1/04; C23F 7/00

[52] U.S. Cl. ..... 427/13; 427/27; 427/127; 427/204; 427/205; 427/419.2; 427/419.3; 148/6; 148/113

[58] Field of Search ..... 427/27, 33, 126.3, 127, 427/104, 126.4, 178, 203, 204, 205, 419.2, 419.3, 13; 148/6, 122, 113, 31.55

[56] References Cited

U.S. PATENT DOCUMENTS 3,969,547 7/1976 Isawa et al. ..... 427/214

4,082,860 4/1978 Corbett et al. ..... 427/27

*Primary Examiner*—Norman Morgenstern

*Assistant Examiner*—Kenneth Jaconetty

*Attorney, Agent, or Firm*—Wenderoth, Lind & Ponack

[57] ABSTRACT

A water repellent, for example an organic silicon compound, is added to an annealing separator which is applied electrostatically to the surface of a grain oriented magnetic steel sheet, or a glass-like film forming undercoating formed on the sheet surface.

1 Claim, 6 Drawing Figures

METHOD OF APPLYING AN ANNEALING SEPARATOR TO GRAIN ORIENTED MAGNETIC STEEL SHEETS

BACKGROUND OF THE INVENTION

1. Field of the Invention

This invention relates to a method of applying an annealing separator to grain oriented magnetic steel sheets electrostatically, to prevent their sticking together when they are annealed at a high temperature. More particularly, it is concerned with a method which enables the industrial application of an annealing separator to grain oriented magnetic steel sheets.

2. Description of the Prior Art

Grain oriented magnetic steel sheets are annealed at a high temperature of at least 900° C. to achieve transformation to the (110)[001] orientation by secondary recrystallization after at least one cycle of cold rolling and annealing. An annealing separator is applied to the surfaces of the steel sheets to prevent their sticking together which may occur during their high temperature annealing.

Various refractory metal compounds have been proposed for use as the annealing separator. They include, for example, $CaCO_3$ and $BaCO_3$ (Japanese Pat. Nos. 179,337 and 185,395), $Al_2O_3$, $ZrO_2$, MgO and $TiO_2$ (Japanese Pat. Publication No. 27533/1967), $Al_2O_3$ and CaO (Japanese Pat. Publication No. 27531/1967) and MgO (Japanese Pat. Publications Nos. 12451/1976 and 31296/1977). For grain oriented magnetic steel sheets containing silicon, it is common to use an annealing separator consisting mainly of magnesium oxide, since it not only prevents the steel sheets from sticking together, but also forms a glass-like film on the steel surface during high temperature annealing by a solid-phase reaction with a sub-scale layer consisting mainly of $SiO_2$. This glass-like film consists mainly of forsterite ($Mg_2SiO_4$) formed by the solid-phase reaction between $SiO_2$ in the sub-scale on the steel surface and MgO in the annealing separator. It is a useful backing for an insulation film, and improves its heat resistance and insulating property.

Various alloying elements are added to grain oriented magnetic steel as a normal grain growth inhibitor to inhibit the growth of primary recrystallization grains during the high temperature annealing which is carried out to effect transformation to the (110)[001] orientation by secondary recrystallization as hereinabove stated. Examples of the alloying elements include Mn, S, Al, N, V, B, Cu, Sn, Sb, Se and Mo. If a compound, such as MnS, AlN, VN, $Cu_2S$ or MnSe, is precipitated, it inhibits the growth of normal grains by pinning the boundary migration of primary recrystallization grains. In the event the intergranular segregation of an element, such as B, Sn, Sb or Mo, takes place, it is dragged with the boundary migration of primary recrystallization grains and resists their migration to thereby inhibit the growth of normal grains. It is known that the transfer of mass on the steel interface contributes greatly to the precipitation or segregation of the alloying element, and therefore, the gas permeability and reactivity of the annealing separator have an important bearing on the secondary recrystallization of steel.

If the steel contains, for example, [S] as the inhibitor, it is necessary to remove it after secondary recrystallization in order to improve its magnetic characteristics. The annealing separator consisting mainly of MgO promotes the desulfurization of steel effectively by absorbing [S] in the vicinity of its surface and lowering its [S] potential.

Thus, the annealing separator consisting mainly of magnesia enables:

(1) prevention of sticking together of steel sheets during high temperature annealing;
(2) formation of a glass-like film;
(3) stabilization of secondary recrystallization; and
(4) promotion of purification (mainly desulfurization) of steel. It is, therefore, a very useful annealing separator for grain oriented magnetic steel sheets. It is, however, evident that magnesia is not the only material for a useful annealing separator for grain oriented magnetic steel sheets, but that any other material can be used if it prevents the sticking together of steel sheets, and if it does not hinder the effective secondary recrystallization of steel.

The annealing separator is usually used in the form of a slurry obtained by dispersing it in water, and is applied to the steel sheet by spraying or roll squeezing after continuous decarbonization annealing. The annealing separator applied in the form of a slurry adheres closely to the steel sheet when it has been dried. The separator consisting mainly of magnesia has a high degree of solid-phase reactivity as hereinabove stated. This method of application, however, has a number of disadvantages, including the following:

(1) A drying furnace is required to dry the slurry, and increases the costs of equipment and energy which are required for the production of grain oriented magnetic steel sheets.
(2) The preliminary heating or soaking of steel sheets at a temperature of 500° C. to 700° C. is required to remove water from the annealing separator on the steel surface prior to high temperature annealing.
(3) Such heating or soaking is, however, not always reliable for the complete removal of water, but it is sometimes likely that the remaining water may be released during high temperature annealing. This brings about the lack of uniformity in the composition of the annealing atmosphere, resulting in the lack of stability in secondary recrystallization and the production of steel not having good magnetic characteristics.
(4) The water released during the high temperature annealing of steel sheets brings about an increase in the oxygen potential thereof, and thereby causes the excessive oxidation of the sheet surfaces, resulting in the production of sheets having inferior magnetic and mechanical properties.

These problems are due to the use of an aqueous suspension of the annealing separator, and can, therefore, be overcome if the annealing separator in dry powder form is applied directly to the surface of the steel sheets. Japanese Pat. Publications Nos. 12211/1964 and 11393/1982 disclose the electrostatic application of the annealing separator in dry powder form.

According to the method disclosed in Japanese Pat. Publication No. 12211/1964, the electrostatic application of the powder is effected by introducing it into the space between the electrode on which a positive corona discharge is formed and the surface of the steel sheet. It states that the annealing separator includes a wide range of substances, such as calcium oxide, alumina, silica or other heat-resistant oxides, lime and the like, and that though the invention is described by way of example with reference to the use of magnesia, such as MgO, it is obvious that the invention is not limited thereto. As regards the magnesia powder, it merely states that the grain size into which magnesia is divided is not critical, but is sufficient if it is fine enough to be carried by air, as hereinafter described. It is sufficient to use magnesia having a particle diameter which passes through a sieve having 325 meshes per inch, or which is about 44 microns. This method is difficult to employ successfully for practical application, since the formation of a positive corona discharge on the electrode brings about a poor charging efficiency resulting in poor adherence of the powder to the steel sheets. Moreover, the method does not enable the formation of a uniform glass-like film on the steel surface.

Japanese Pat. Publication No. 11393/1982 discloses a method which comprises applying a small quantity of a slurry consisting mainly of a magnesium oxide to form a good glass-like film as an undercoating on a silicon steel sheet, drying it, and charging particles of an annealing separator on the film to cause them to adhere to the surface of the sheet serving as an electrode. As regards the annealing separator for preventing sticking, it states that the method uses heavy magnesia, alumina, zirconium oxide, silicic acid, titanium oxide, nickel oxide, manganese oxide, calcium oxide, chromium oxide, molybdenum oxide or boron oxide, or a mixture or composite thereof. These oxides are used in the form of a powder having a particle size of 100 mesh (preferably 325 mesh). The method, however, lacks stability for continuous operation.

Although a variety of heat-resistant oxides in powder form are electrostatically applied as an annealing separator, the cohesion of the powder, resulting from absorbing moisture, causes the blocking of the apparatus used for the electrostatic application of the powder. This prevent a long period of reliable operation. A long period of reliable operation requires the use of a fully dried powder in a completely dry environment, but the complete removal of moisture from the powder is difficult to achieve on the spot in industrial production and requires expensive equipment.

SUMMARY OF THE INVENTION

It is an object of this invention to eliminate the drawbacks of the prior art as hereinabove discussed, and provide a method which enables industrially the electrostatic application of an annealing separator in a process for the production of grain oriented magnetic steel sheets.

The electrostatic application of a powder requires a powder having a high degree of fluidity and electrical chargeability. Although an industrially established method is available for the electrostatic application of an organic paint or the like, no method has yet been established for the electrostatic application of an annealing separator to grain oriented magnetic steel sheets due to the presence of the problems which have hereinabove been pointed out.

The present inventors have made an extensive study of a method which improves the fluidity and electrical chargeability of a heat-resistant inorganic compound used as an annealing separator, and which prevents the sticking together of steel sheets to enable the effective secondary recrystallization of the steel. As a result, they have found that a long period of stability can be attained in the electrostatic application of an annealing separator if a specific substance is added to the powder of the annealing separator to render it hydrophobic so that it may not absorb moisture, and that the addition of a specific quantity of the substance stabilizes the quality of the annealing separator. Thus, this invention provides a method which employs an annealing separator carrying a specific quantity of a water repellent on its particle surfaces.

BRIEF DESCRIPTION OF THE DRAWINGS

FIGS. 4 to 6 show the results of EXAMPLE 2, FIGS. 4 and 5 showing the quantity of a water repelent and the magnetic properties, and wherein FIG. 6 shows the relationship between the quantity of a water repellent and the carbon content of steel.

DETAILED DESCRIPTION OF THE INVENTION

Figure 1:
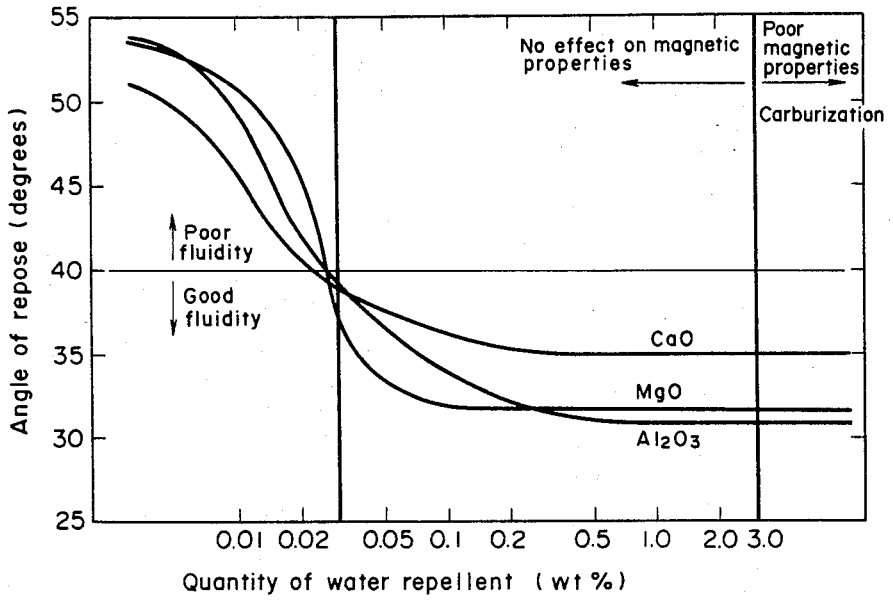
FIG. 1 is a graph showing the relationship between the quantity of a water repellent in CaO, MgO or $Al_2O_3$ and the angle of repose.

A refractory inorganic compound is a better electrical conductor and has a lower degree of electrical chargeability than an organic powder paint. It can remain charged with electricity for only a short time. Therefore, it does not lend itself to reliable electrostatic application. A hydroxyl (—OH) group is likely to form on the particle surfaces of an inorganic compound if they adsorb a water molecule, and render them hydrophilic. An increase in their electrical conductivity renders them difficult to charge with electricity. An accelerated adsorption of water molecules takes place in the active sites which have been rendered hydrophilic and results in an increase in the cohesion of particles and a reduction in their fluidity. The addition of a water repellent to the particle surfaces according to this invention is a simple, but very effective method for increasing the electrical resistance of particles and preventing their absorption of moisture.

It is possible to use any substance as a water repellent for the purpose of this invention if it has a hydrophobic group, and if it does not hinder the effective secondary recrystallization of steel. It is, therefore, possible to use, for example, polyethylene, polypropylene, vinyl, acryl, alkyd, urethane, epoxy, polyester or phenolic resin, or a modified product thereof, or an organic resin further containing a halogen such as fluorine or chlorine, or a silicone resin or other organic silicon compound containing a silane or siloxane, or a mixture thereof.

A water repellent can be added to the annealing separator by any ordinary method. For example, if the process for the preparation of the powder of an inorganic compound used as the annealing separator includes the step of crushing by a crusher, ball or vibration mill, or the like, or the step of classification by a sieve, venturi, cyclone or the like, a predetermined quantity of a water repellent can be added to the powder at the time of crushing or classification easily without the aid of any additional equipment. If a powder having an appropriate particle size is available for use as the annealing separator, it may be mixed with a water repellent by a ball or vibration mill, or the like. It is also possible to supply a water repellent automatically by a screw feeder, or spray, or the like into a storage or feed tank for the powder. The water repellent can be used in various forms, including a gas, liquid, solid, emulsion or dilution. It is also possible to employ a master powder or pellet prepared by adding a large quantity of the water repellent to some of the annealing separator.

The water repellent is not always required to cover the entire surfaces of the powder particles, but it is sufficient for the annealing separator to contain a specific quantity of the water repellent. It is necessary to employ a minimum of 0.03% by weight of the water repellent in order to prevent any absorption of moisture by the annealing separator and thereby improve its fluidity and electrical chargeability. The annealing separator is used not only to prevent the sticking together of steel sheets during their high temperature annealing, but also to control the transfer of mass on the steel interface to stabilize its secondary recrystallization and promote its purification. It is, therefore, necessary to avoid the use of over 3.00% by weight of the water repellent, since it has an adverse effect on the secondary recrystallization of steel during its high temperature annealing, and also because the water repellent, which is an organic substance, causes carburization resulting in the deterioration of the steel properties.

Figure 2:
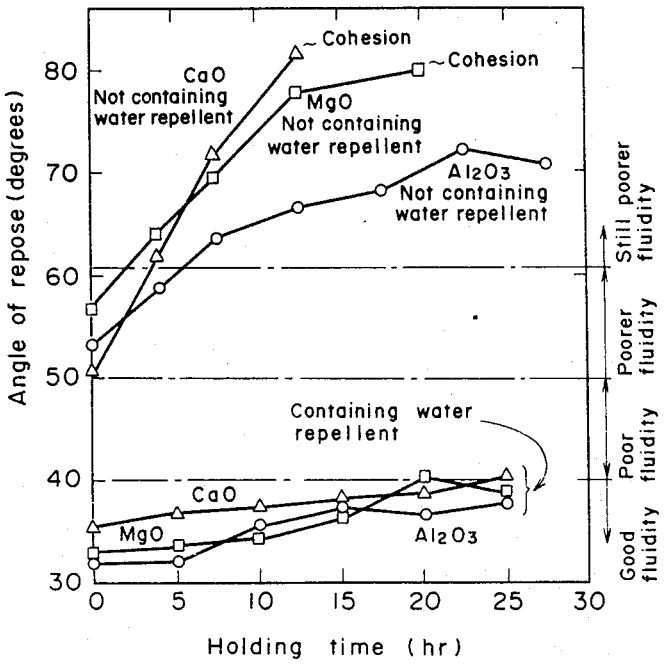
FIG. 2 is a graph showing the relationship between the holding time and a change in the angle of repose for CaO, MgO and $Al_2O_3$ which contain a water repellent, and which do not contain any water repellent.

FIGS. 1 and 2 show the results of the tests conducted to ascertain the effect of the water repellent on the fluidity of the powder. Although a lot of parameters have hitherto been used to indicate the fluidity of a powder, the present specification employs the angle of repose which appears as a specific value in a powder process, and which has long been used to express the fluidity of a powder. The angle of repose is an angle which the free surface of a powder layer in a moving field has to the horizontal when it has reached a stress limit, and can be determined by a number of methods, including the injection, discharge or inclination method. The inventors have employed the injection method which is the most basic method for the determination of the angle of repose. The powder consisted of $A_2O_3$, MgO or CaO particles capable of passing fully through a sieve having 325 meshes per inch. The water repellent was dimethylpolysiloxane having a polymerization degree of 9, and employed in the quantity of 0 to 7.0% by weight. It was stirred with the powder in a ball mill for 120 minutes.

FIG. 1 shows the reasons for the upper and lower limits on the quantity of the water repellent to be added to the annealing separator. The use of at least 0.03% by weight of the water repellent brings about a reduction in the angle of repose and provides improved fluidity, while the use of more than about 1% by weight no longer brings about any appreciable reduction in the angle of repose. The use of the water repellent in any quantity exceeding 3% by weight is merely a waste of the material, and should also be avoided since it causes carburization resulting in the deterioration of steel properties. The powders of $Al_2O_3$, CaO and MgO not containing any water repellent, and those containing 0.1% by weight of the water repellent were held in a tank having a constant temperature of 40° C. and a constant relative humidity of 85%. FIG. 2 shows the changes which were observed in the angle of repose in relation to the holding time. The powders containing the water repellent maintained good fluidity for a long time, while the powders not containing any water repellent showed an increasing angle of repose and a reduction in fluidity with the lapse of time, and indicated even the possibility of cohesion with the lapse of 12 to 20 hours.

The electrostatic application of the annealing separator may, for example, be carried out as will hereinafter be described. The particles of the annealing separator are uniformly dispersed in a fluidizing or feeding tank, introduced with a carrier gas into the vicinity of a corona electrode in an electrostatic powder applicator, charged with positive or negative electricity by impinging upon or contacting the gas ionized by a corona discharge created by application of a high DC voltage to the corona electrode, and caused to adhere to a grounded steel sheet surface serving as a counter electrode. The positively or negatively charged particles fly toward the steel sheet with the carrier gas along the lines of electric force in an electric field formed by a potential between the corona electrode and the grounded steel sheet, and after having electrostatically adhered thereto, they lose the electric charge and are adsorbed on the steel sheet. The polarity of the electricity with which the particles are charged coincides with that of the corona electrode, and they adhere to the steel sheet, whether they are charged with positive or negative electricity. It has, however, been found that the negatively charged particles adhere more firmly to the steel sheet.

This invention enables the electrostatic application of the annealing separator on an industrial basis by employing a water repellent to render it hydrophobic. This is, however, not the only advantage of this invention, as will hereinafter be described.

An annealing separator consisting mainly of magnesia which enables (1) prevention of sticking together of steel sheets, (2) formation of a glass-like film, (3) stabilization of secondary recrystallization and (4) purification (mainly desulfurization) is usually used for grain oriented magnetic steel sheets containing silicon, as hereinbefore stated. This invention contributes effectively to the formation of a glass-like film. Reference is made, for example, to the use of an organic silicon compound as a water repellent for an annealing separator consisting mainly of magnesia. A uniform film consisting mainly of forsterite is formed during high temperature annealing by a solid-phase reaction between a sub-scale layer formed during decarburization annealing and consisting mainly of $SiO_2$, and the annealing separator. The formation of this film apparently requires not only $SiO_2$ from the sub-scale layer, but also the supply of Si from the base metal. This assumption is believed to be correct, since the glass-like film consisting mainly of forsterite has a thickness which is two or three times larger than that of the sub-scale layer, which is not more than about 2 $\mu$m, since the examination of a steel sheet cross section by EPMA indicates a gradual reduction in the quantity of Si from the center of the sheet to its surface, and since an inner oxidized layer having voids considered to have been formed due to the shortage of Si exists immediately below the glass-like film. A decrease in the quantity of Si in the steel sheet brings about a reduction in the specific resistance thereof. The internal oxidation gives an uneven sheet surface which resists the movement of a magnetic domain wall under load, leading to increased core losses in magnetic steel sheets. If an organic silicon compound is added to the annealing separator, it supplies Si during high temperature annealing to prevent the loss of Si in the base metal and the growth of an inner oxidized layer, and enables the formation of a sound glass-like film. The electrostatic application of the annealing separator permits any desired pretreatment, since the steel sheet is not in contact with any applicator. For example, it is possible to separate the formation of a glass-like film and the prevention of sticking of steel sheets in the method disclosed in Japanese Pat. Publication No. 11393/1982 so that after an undercoating for a glass-like film has been formed from a solution consisting mainly of magnesia, the annealing separator containing a water repellent according to this invention may be electrostatically applied to form a top coating. It is known that grain oriented magnetic steel sheets containing silicon and produced by employing an inhibitor consisting of one or more of elements, such as MnS, AlN, B, Se, Sb, Sn, Cu and Mo, have improved magnetic properties if a solution consisting mainly of a magnesium oxide and employed for forming a glass-like film contains, for example, an oxide, sulfide, sulfate, nitride, nitrate, thiosulfate or nitrite of titanium, manganese, boron, silicon, niobium, chromium, nickel, molybdenum, antimony or strontium, or a mixture thereof. According to this invention, the use of. any such additive provides greater results and enables a drastic improvement in the magnetic properties of steel, since it restricts any adverse effect by water during high temperature annealing.

Although there have so far been proposed a lot of inventions relating to the prevention of sticking together of grain oriented magnetic steel sheets during high temperature annealing, and the formation of a glass-like film consisting mainly of forsterite, this invention is particularly of great industrial value, since it facilitates the continuous elctrostatic application of an annealing separator with reliability for a long period of time, and enables the constant production of grain oriented magnetic steel sheets of high quality.

The invention will now be described in further detail with reference to several examples and comparative examples.

EXAMPLE 1

Particles of $Al_2O_3$, CaO and MgO passing fully through a 200-mesh sieve were used as an annealing separator, and treated under the conditions stated below. Attempts were made to apply those particles electrostatically in the quantity of $6\pm1$ g/m$^2$ on one side of a steel strip having a width of 1,000 mm and traveling at a speed of 50 m/min, and changes occurring in the quantity of adhering particles with the lapse of time were studied. A voltage of $-100$ kV was applied to a corona electrode, and the electrostatic application of the particles was carried out at an ambient temperature of 35° C. and a relative humidity of 61%.

Treating Conditions:

(1) Water repellent
  (a) Tetrafluoroethylene
  (b) Tolylene diisocyanate
  (c) Polysiloxane (having a polymerization degree n of 9)

(2) Quantity of water repellent
  (a) 0
  (b) 0.5% by weight (3) Mixing
  In a ball mill for 120 min.

Figure 3:
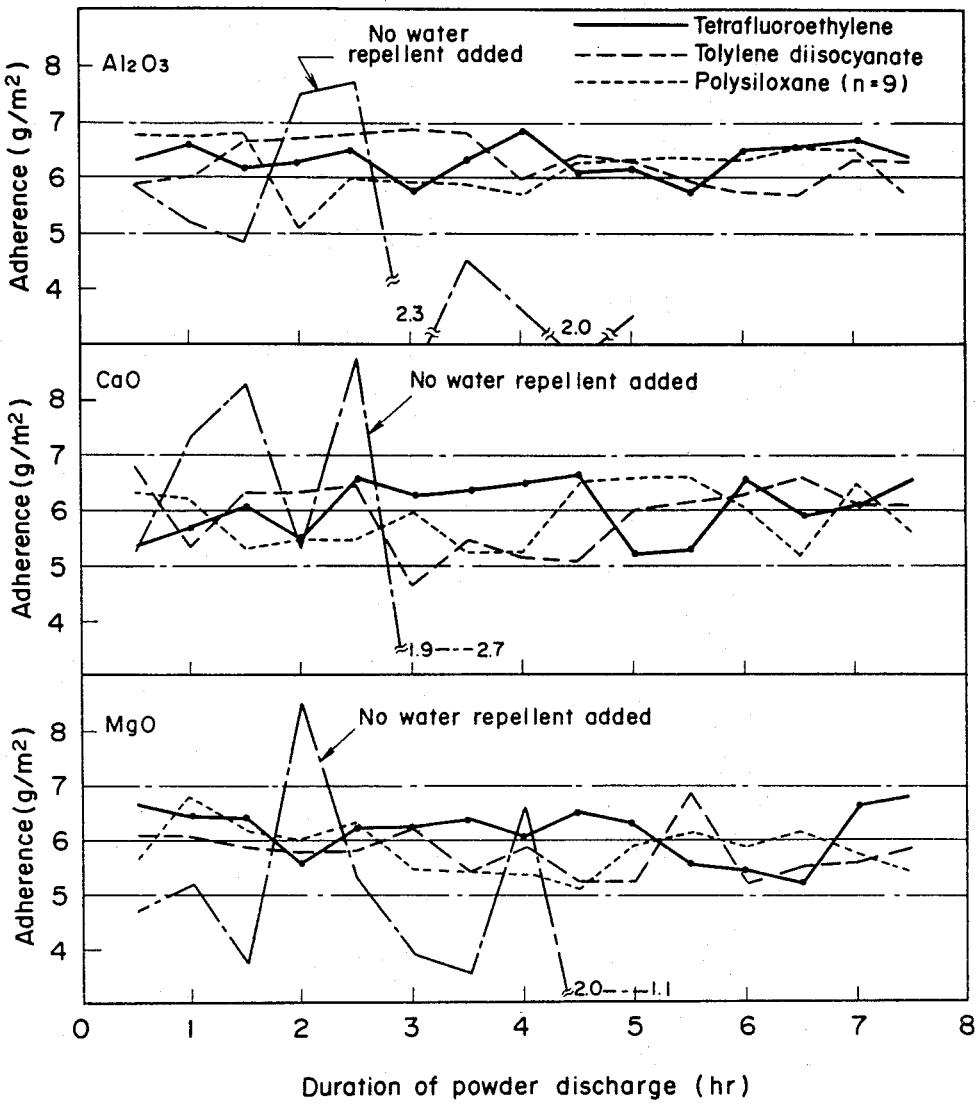
FIG. 3 is a graph showing the result of EXAMPLE 1 for the relationship between the powder application time and its adherence for $Al_2O_3$, CaO and MgO which contain a water repellent, and which do not contain any water repellent.

The results are shown in FIG. 3. All of $Al_2O_3$, CaO and MgO not containing any water repellent were difficult to apply in the aforesaid quantity, and showed a great reduction in adherence with the lapse of time. On the other hand, a long period of stability was ascertained in the electrostatic application of the particles containing any of the water repellents (a) to (c).

EXAMPLE 2

Figure 4:
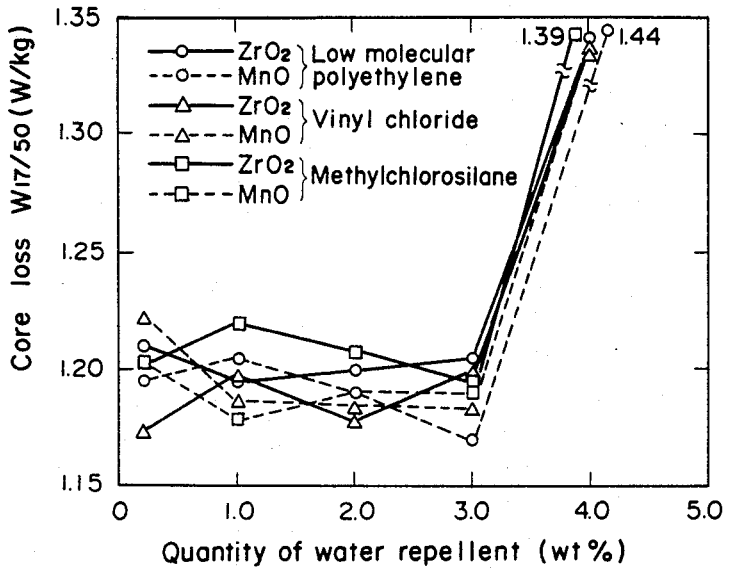
Figure 5:
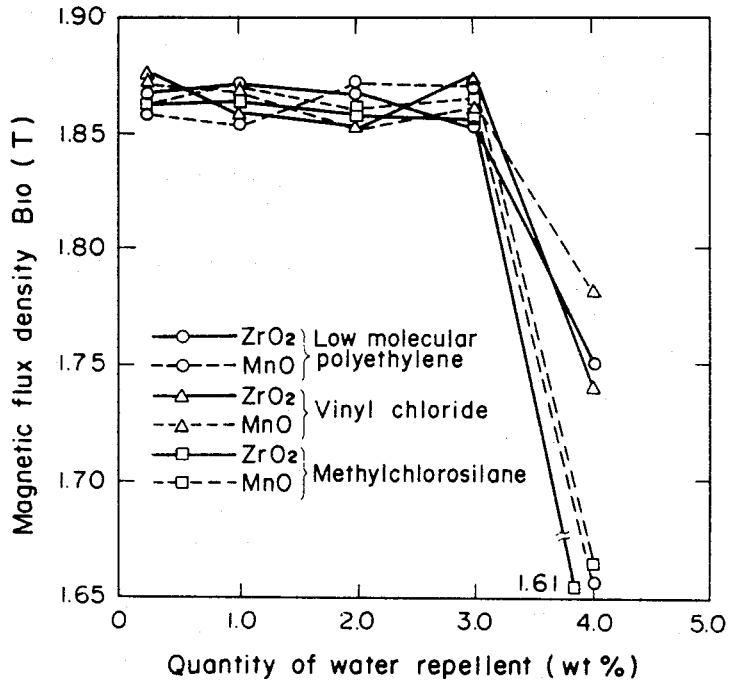
Figure 6:
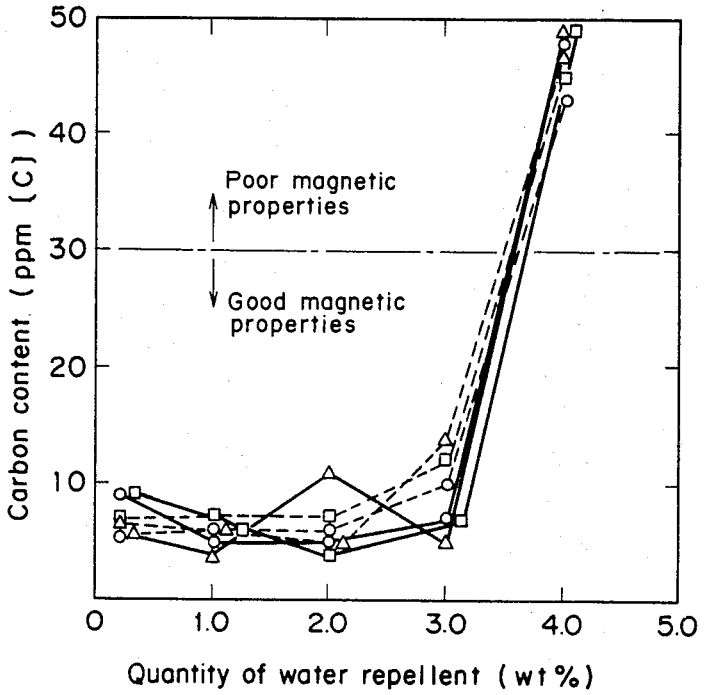

This example relates to the production of a grain oriented magnetic steel sheet containing 3.2% Si and having a thickness of 0.3 mm, a width of 300 mm and a weight of 450 kg. After finish cold rolling, the rolling fluid was removed, and the steel sheet was subjected to continuous decarburization annealing at 830° C. for four minutes in an atmosphere containing 75% $H_2$ and 25% $N_2$ and having a dewpoint of 43° C. Various annealing separators were prepared by adding 0.2, 1.0, 2.0, 3.0 and 4.0% by weight of (a) low moleular polyethylene, (b) vinyl chloride or (c) dimethylchlorosilane to $ZrO_2$ or MnO, and mixing in a ball mill for 120 minutes. The annealing separator was charged with negative electricity by application of a high voltage of $-100$ kV, and caused electrostatically to adhere in a weight of 6.0 to 7.0 g/m$^2$ to the upper surface of the steel sheet serving as a counter electrode. The sheet was immediately wound into a coil. The coil was annealed at 1,200° C. for 12 hours in a hydrogen atmosphere, and cooled. When the coil was unwound, no sticking was found. After the annealing separator had been removed, the magnetic properties of the steel sheets were examined. The sheets which had been treated with the annealing separator containing 0.2 to 3.0% by weight of the water repellent showed good magnetic properties, but the sheets which had been treated with the annealing separator containing 4.0% by weight of the water repellent showed inferior magnetic properties. The chemical analysis of the base metal indicated that carburization had taken place in the steel treated with the annealing separator containing 4.0% by weight of the water repellent. The magnetic properties are shown in FIGS. 4 and 5, and the carbon content found by the chemical analysis of the base metal in FIG. 6.

EXAMPLE 3

This example relates to the production of a grain oriented magnetic steel sheet containing 3.15% Si and having a thickness of 0.3 mm, a width of 350 mm and a weight of 470 kg. After finish cold rolling, the rolling fluid was removed, and the steel sheet was subjected to continuous decarburization annealing at 840° C. for four minutes in an atmosphere containing 75% $H_2$ and 25% $N_2$ and having a dewpoint of 45° C. An annealing separator was prepared by adding 0.3% by weight of polysiloxane having a polymerization degree n of 7 to MgO and mixing for 90 minutes in a vibrating mill. The mixed powder was charged with negative electricity by application of a high voltage of $-100$ kV, and caused electrostatically to adhere in a weight of 6.0 to 7.0 g/m$^2$ to the lower surface of the steel sheet serving as a counter electrode. The sheet was immediately wound into a coil. The coil was annealed at 1,200° C. for 10 hours in a hydrogen stream without being subjected to any preliminary heat treatment, and cooled. When the coil was unwound, no sticking was found. After the unreacted MgO had been removed, the sheet surface was examined. A uniform grey glass-like film was found on both sides of the sheet both transversely and longitudinally thereof. The chemical analysis of the base metal indicated complete desulfurization. The properties of the film thus obtained are shown in TABLE 1.

COMPARATIVE EXAMPLE 1

The same material as in EXAMPLE 3 was continuously annealed under the same conditions. An annealing separator was prepared by mixing 100 parts of light magnesia containing at least 95% of particles having a particle diameter not exceeding 5 μm, three parts of titanium oxide and 400 parts of water. It was uniformly applied to the steel sheet by rubber roll squeezing, and dried at 400° C. for 30 seconds. The sheet was immediately wound into a coil. The upper and lower surfaces of the sheet were found to carry 7.2 g/m$^2$ and 7.5 g/m$^2$, respectively, of the dry powder. The powder showed a hydration ratio of 9.1% ($H_2O/MgO \times 100$). The coil was preliminarily soaked at 600° C. for 15 hours in a hydrogen stream, and annealed at 1,200° C. for 10 hours. After the coil had been cooled, it was unwound, and the excess of the powder was removed from the sheet. No sticking was found. A dense dark-grey glass-like film was found in an area having a width of 70 to 120 mm along each longitudinal edge of the sheet, while the film in the center of the sheet was partly white, coarse, and not closely adhering. The properties of the film thus obtained are shownin TABLE 1.

EXAMPLE 4

The same material as in EXAMPLE 3 was continuously annealed under the same conditions. A glass-like film forming solution was prepared by mixing 100 parts of light magnesia containing at least 95% of particles having a diameter not xceeding 5 μm, three parts of titanium oxide and 600 parts of water. It was uniformly applied to the steel sheet by rubber roll squeezing, and dried at 300° C. for 30 seconds. The sheet was found to carry 2.4 g/m$^2$ and 2.0 g/m$^2$ of dry powder on its upper and lower surfaces, respectively. The powder showed a hydration ratio of 6.2% ($H_2O/MgO \times 100$). An annealing separator for preventing the sticking of steel sheet was prepared by adding 0.1% by weight of siloxylmethylene as a water repellent to aluminum oxide having a particle diameter of 325 mesh, and mixing for 90 minutes in a ball mill. It was charged with negative electricity by application of a high voltage of −100 kV, and caused electrostatically to adhere in a weight of 6.0 to 7 0 g/m$^2$ to the lower surface of the steel sheet serving as a counter electrode. The sheet was immediately wound into a coil. The coil was annealed at 1,200° C. for 10 hours in a hydrogen stream. After the coil had been cooled, it was unwound, and the excess powder was washed away with water. No sticking was found. A uniform dense grey glass-like film was found both transversely and longitudinally of the sheet. The properties of the film thus obtained are shownin TABLE 1.

EXAMPLE 5

The same material as in EXAMPLE 3 was annealed under the same conditions, and the same glass-like film forming solution as used in EXAMPLE 4 was applied to the sheet. It was applied in the quantity of 2.2 and 1.9 g/m$^2$ to the upper and lower surfaces, respectively, of the sheet. It showed a hydration ratio of 6.4% ($H_2O/MgO \times 100$). An annealing separator was prepared by adding 0.1% by weight of polysiloxane (n=7) as a water repellent to magnesia clinker having a particle diameter of 325 mesh, and mixing for 90 minutes in a ball mill. It was charged with negative electricity by application of a high voltage of −100 kV, and caused electrostatically to adhere in a weight of 6.0 to 7.0 g/m$^2$ to the lower surface of the sheet serving as a counter electrode. The sheet was immediately wound into a coil. The coil was annealed at 1,200° C. for 10 hours in a hydrogen atmosphere. After the coil had been cooled, it was unwound, and the excess powder was washed away with water. No sticking was found. A uniform dense grey glass-like film was found both transversely and longitudinally of the sheet. The properties of the film are shown in TABLE 1.

EXAMPLE 6

The annealing, coating and heat treating procedures of EXAMPLE 5 were repeated for the production of a grain oriented magnetic steel sheet containing 3.25% Si and 0.030% sol. Al. No sticking was found. The properties of the film thus obtained are shown in TABLE 1, and the magnetic properties of the sheet in TABLE 2.

EXAMPLE 7

The same material as in EXAMPLE 6 was annealed under the same conditions, and continuously annealed at 850° C. for four minutes in an atmosphere containing 75% $H_2$ and 25% $N_2$ and having a dewpoint of 45° C. A glass-like film forming solution was prepared by mixing 100 parts of the coating agent disclosed in Japanese Pat. Publication No. 31296/1977, five parts of titanium oxide, three parts of strontium sulfide and 600 parts of water. It was uniformly applied to the sheet surface by rubber roll squeezing, and dried at 400° C. for 20 seconds. The sheet was found to carry 1.7 and 2.1 g/m$^2$ of dry powder on its upper and lower surfaces, respectively. The powder showed a hydration ratio of 10.0% ($H_2O/MgO \times 100$). An annealing separator was prepared by adding 0.1% by weight of polysiloxane (n=7) as a water repellent to magnesia clinker powder having a particle diameter of 325 mesh, and mixing for 90 minutes in a ball mill. The mixed powder was charged with negative electricity by application of a high voltage of −100 kV, and caused electrostatically to adhere in a weight of 6.0 to 7.0 g/m$^2$ to the lower surface of the steel sheet serving as a counter electrode. The sheet was immediately wound into a coil. The coil was annealed at 1,200° C. for 10 hours in a hydrogen stream. After the coil had been cooled, it was unwound, and the excess of the powder was washed away with water. No sticking was found. A uniform dense lustrous grey glass-like film was found on the entire upper and lower surfaces of the sheet. The properties of the film are shown in TABLE 1, and the magnetic properties of the sheet in TABLE 2.

EXAMPLE 8

The procedures of EXAMPLE 7 were repeated, except that seven parts of chromium nitride were used instead of strontium sulfide for preparing the glass-like film forming solution. No sticking was found. A uniform dense lustrous grey glass-like film was formed on both surfaces of the sheet both transversely and longitudinally thereof. The properties of the film are shown in TABLE 1, and the magnetic properties of the sheet in TABLE 2.

TABLE 1

| | | Film properties | | | | | | | |
|---|---|---|---|---|---|---|---|---|---|
| | | | Comparative Example 1 | | | | | | |
| | | Example 3 | Strip edges | Strip center | Example 4 | Example 5 | Example 6 | Example 7 | Example 8 |
| Glass-like film | Unit weight ($g/m^2$) | 1.4/1.5 | 2.3/2.1 | 0.7/0.5 | 2.0/1.7 | 2.1/1.9 | 1.9/1.8 | 1.7/1.9 | 1.8/2.0 |
| | Adhesion | No peeling at 20 mmθ | No peeling at 20 mmθ | No peeling at 50 mmθ | No peeling at 20 mmθ | No peeling at 20 mmθ | No peeling at 20 mmθ | No peeling at 20 mmθ | No peeling at 20 mmθ |
| *After insulating film formation | Interlayer resistance ($\Omega$-$cm^2$/sheet) | 250–∞ | ∞ | 10–100 | 250–∞ | ∞ | ∞ | ∞ | ∞ |
| | Voltage resistance (V) | 250< | 250< | 0–200 | 250< | 250< | 250< | 250< | 250< |
| | Adhesion | No peeling at 20 mmθ | No peeling at 20 mmθ | No peeling at 100 mmθ | No peeling at 20 mmθ | No peeling at 20 mmθ | No peeling at 20 mmθ | No peeling at 20 mmθ | No peeling at 20 mmθ |
| | Appearance | Grey and uniform | Grey and uniform | Red and non-uniform | Grey and uniform | Grey and uniform | Grey and uniform | Grey and uniform | Grey and uniform |
| Chemical analysis of base metal | [S] (ppm) | 7 | 6 | 9 | 5< | 5< | 6 | 8 | 7 |
| | [C] (ppm) | 9 | 8 | 6 | 6 | 7 | 9 | 7 | 7 |

Note:
Adhesion is expressed by a minimum column diameter which did not cause any film separation when the steel sheet was wound about the column. Comparative Example 1 indicates poor adhesion in strip center, and the red non-uniform appearance indicates the failure to produce a good glass-like film.
*The insulating film was formed by applying 4.0 $g/m^2$ of an aqueous solution of aluminum hydrophosphate and chromic acid, and firing at 650° C. for 60 sec.

TABLE 2

| | Magnetic properties | | |
|---|---|---|---|
| | EXAMPLE 6 | EXAMPLE 7 | EXAMPLE 8 |
| Core loss $W_{17/50}$ (W/kg) | 0.98 | 0.98 | 0.95 |
| Magnetic flux density | 1.91 | 1.96 | 1.94 |

TABLE 2-continued

| | Magnetic properties | | |
|---|---|---|---|
| | EXAMPLE 6 | EXAMPLE 7 | EXAMPLE 8 |
| $B_{10}$ (T) | | | |

What is claimed is:

1. In a method of applying an annealing separator electrostatically to a glass-like film-forming undercoating consisting mainly of a magnesium oxide on the surface of a grain oriented magnetic steel sheet, thus overcoating said undercoating, the improvement wherein said annealing separator contains an organic silicon compound in a quantity of 0.3 to 3.00% by weight.

* * * * *